United States Patent [19]

Wang

[11] 4,200,281

[45] Apr. 29, 1980

[54] ELASTIC PULL TYPE EXERCISING DEVICE

[76] Inventor: Clifford Wang, 839 Newburg Ave., N. Woodmere, N.Y. 11581

[21] Appl. No.: 841,989

[22] Filed: Oct. 13, 1977

[51] Int. Cl.[2] ..... A63B 21/02

[52] U.S. Cl. ..... 272/138; 272/142

[58] Field of Search ..... 272/136, 137, 138, 142, 272/143

[56] References Cited

U.S. PATENT DOCUMENTS

| | | | |
|---|---|---|---|
| 992,272 | 5/1911 | Singer | 272/142 |
| 1,815,863 | 7/1931 | Noe | 272/142 |
| 3,677,543 | 7/1972 | Richardson | 272/136 |

*Primary Examiner*—William R. Browne

*Attorney, Agent, or Firm*—Friedman, Goodman & Teitelbaum

[57] ABSTRACT

An exercising device including a base plate and elastic straps extending from the base plate. The base plate is formed with lateral extensions on which a user can stand while stretching the elastic straps. At least one channel is provided in the base plate with at least one slot extending from the channel through the base plate. One end of each strap is connected to a block-like lug which securely fits into the channel, with the strap extending through the slot. In this way, the straps are securely held in position by the base plate. In addition to an upwardly extending vertical pair of straps, there also may be provided a horizontal pair of straps laterally extending from the base plate. One or more straps may be connected to one block-like lug, where the straps may extend in the same direction and/or at a right angle to each other.

10 Claims, 15 Drawing Figures

ELASTIC PULL TYPE EXERCISING DEVICE

BACKGROUND OF THE INVENTION

This invention relates in general to physical exercise devices, and more particularly to an exercising device using stretching elastic bands.

Exercising devices are very popular for maintaining good health and proper physical condition. Although many exercising devices are cumbersome and require the facilities of a well equipped gym, more and more exercising devices are being provided for use by an individual in his own home. Such devices are generally of a type which must be easy to assemble and simple to manipulate, and should be both inexpensive as well as useful for developing proper physical conditions.

One popular type of exercising device provides a spring type material with substantial resistance which is pulled by the individual's hands, legs, or other parts of the body. The pulling against the biasing spring, or other elastic material, provides the necessary resistance against which the muscles pull and provides physical stress for developing the muscular areas. Heretofore, most of these stretching type exercising devices have required complex installations involving interconnections to a wall, or other stationary support. As a result, most of the exercise devices utilizing a stretching principle were only available in well equipped gyms. Some attempts have been made to provide these items in simplier form for use in the home as well as in gyms, however these have also been bulky and have not been widely accepted.

One such device is shown in U.S. Pat. No. 118,740. In that patent there is shown a base plate with upwardly extending rubber straps or springs. The user can stand on the base plate and pull up against the straps or springs. Such a lifting exercising device is of the type desired, however, there is not provided any interchangeability of the straps, nor is there taught any method of interconnecting the straps to the base plate.

One of the most important needs of having an exercising device which can be utilized in a simple manner at home, is to make the device so that it can be easily assembled and disassembled. Furthermore, once assembled it should be retained in a firm, secure and sturdy manner to avoid accidents. Such type of easily assembled, portable, yet sturdy exercising device of the lifting and stretching type has not heretofore been provided.

SUMMARY OF THE INVENTION

Accordingly, it is an object of the present invention to provide an exercising device which avoids the aforementioned problems of prior art devices.

A further object of the present invention is to provide an exercising device of the type utilizing elastic straps, which is sturdy, easily assembled, secure, and can be easily manipulated by a user.

Another object of the present invention is to provide an exercising device having elastic bands in two mutually perpendicular directions, which can be stretched by hands, legs, and other muscular parts of the body.

Still a further object of the present invention is to provide an exercising device which can be easily assembled by a user, and does not require any complex installation whereby it can be used in the home as well as in the gym.

Another object of the present invention is to provide a simplified exercising device which provides good exercising of hand and leg muscles, and which is firmly secured to avoid accidents.

Briefly, the invention provides for an exercising device having a base plate with at least one channel therein, and at least one slot extending through the base plate to the channel. Elastic straps are also provided, with the straps including a handle at one end thereof, and a block-like lug at the other end thereof. The shape of the block-like lug corresponds to the shape of the channel. The channel receives the block-like lug to secure the straps to the base plate, with the straps passing through the slot or slots and extending from the base plate.

In one embodiment of the invention, there are provided two vertical straps upwardly extending from the base plate. In another embodiment of the invention, there is also provided two horizontal straps laterally extending from the base plate. There can either be a separate block-like lug at the proximal end of each strap, or a single vertical and single horizontal strap can be interconnected by a common block-like lug maintaining the straps in an L-shaped configuration. Additionally, all four straps can be interconnected at their proximal ends to a single block-like lug.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENTS

Figure 1:
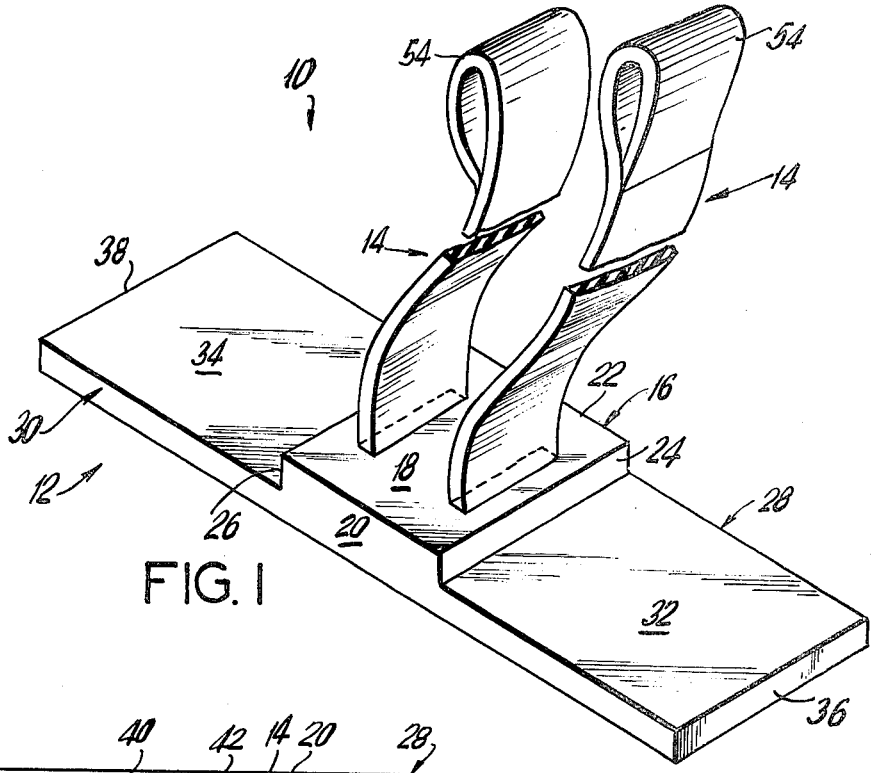
FIG. 1 is a perspective view of one embodiment of the exercising device of the present invention.
Figure 2:
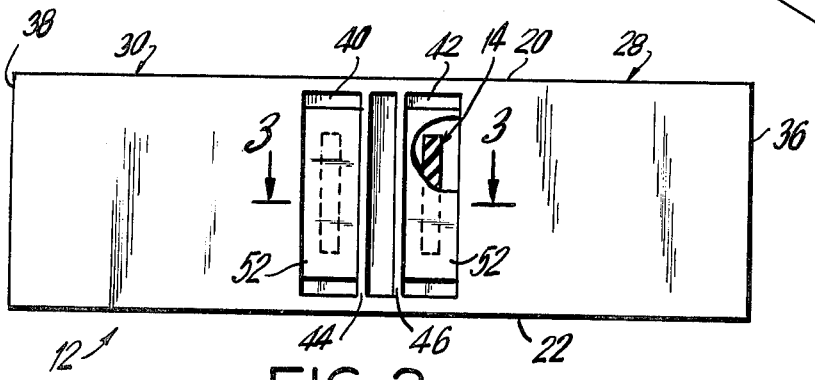
FIG. 2 is a bottom view of the device shown in FIG. 1 with a portion cut away.

Referring now to FIGS. 1–4, the exercising device of the present invention is shown generally at 10 and includes a base plate, shown generally at 12, and two elastic straps, shown generally at 14. The base plate 12 includes an enlarged central portion 16 of substantially rectangular configuration having a top surface 18, a front wall 20 and a rear wall 22. Side walls 24 and 26 are also provided. Laterally extending from the enlarged central portion are lateral extensions 28 and 30. Each of these lateral extensions are elongated rectangular portions, each respectively having a flat top surface 32, 34, with remote ends 36, 38. The front wall 20 is integral with the front of the lateral extensions, and similarly for the rear wall 22. The side walls 24, 26 of the central enlarged portion extend respectively upwardly above the top surfaces 32, 34 of the lateral extensions 28, 30. As is noted from FIG. 2, the bottom of the entire base plate lies in a single common plane which can be positioned on a flat support surface.

Figure 3:
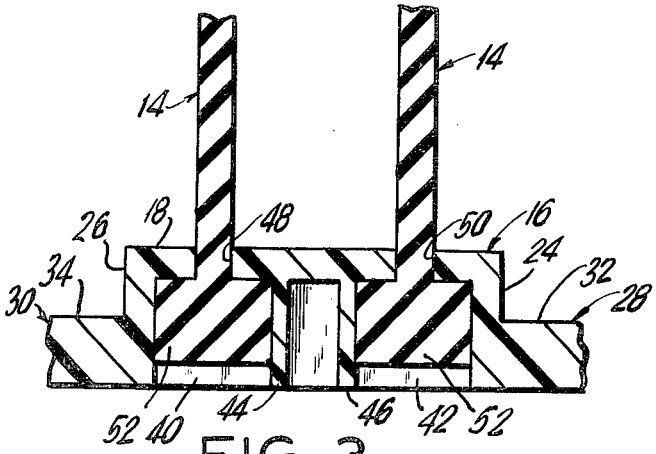
FIG. 3 is a side sectional view taken along line 3—3 of FIG. 2.

Formed into the bottom of the base plate, and specifically into the enlarged central portion thereof, are rectangular channels or recesses 40, 42. The channels are separated by downwardly depending internal walls 44, 46 which interconnect the front and rear walls 20, 22 internally of the enlarged central portion. The channels are defined by these downwardly depending walls 44, 46 in conjunction with the side walls 24, 26, as shown in FIG. 3, and the front and rear walls 20, 22. Extending from each of the channels through the top wall 18 of the enlarged central portion 16 are slots 48, 50. The slots are respectively in communication with the channels 40, 42 and extend upwardly through the enlarged central portion 16 of the base plate.

Figure 4:
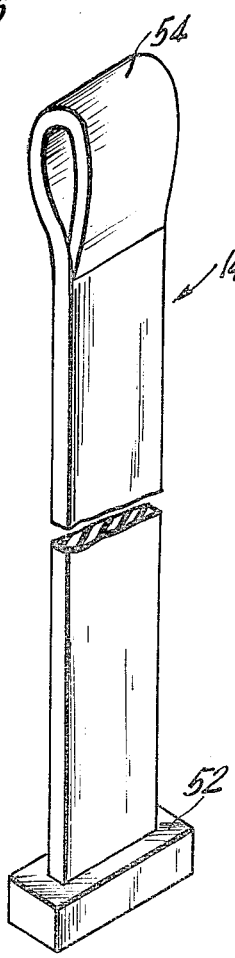
FIG. 4 is a perspective view of one of the straps including the block-like lug.

Each of the straps 14 are formed of elastic material and terminate at their lower end in block-like lugs 52, as best shown in FIG. 4, which correspond in shape to the channels 40, 42 formed in the base plate. The shape shown in the figures is that of a rectangular block which is larger in its transverse cross-sectional area than the transverse area through the elastic straps. At the distal ends of the straps are formed handles 54. As shown, the handles are provided by folding over an end portion of the strap onto itself and fastening it by suitable means such as an adhesive, cement, heat treatment and the like, to the lower portion of the strap to form a loop.

In assembling the exercising device, the block-like lugs 52 are respectively inserted into corresponding channels so that the straps pass through the slots, thereby permitting the straps to pass through the base plate and extend upwardly therefrom. In utilizing the device, the individual can stand with his feet placed upon the laterally extending portions of the base plate, whereby his weight will maintain the base plate securely positioned on a support surface. He can then insert his hands into the loops at the end of the elastic straps and pull and stretch the straps, thereby gaining the proper exercise for his muscles. By pulling on the straps, the user further secures the block-like lugs in their respective channels, whereby they are held even more securely in place within the base plate. Because of the use of the combination of channels and lugs, there is provided a very secure coupling between the straps and the base plate to avoid the possibility of having the straps accidentally pull out and spring away from the base plate. Furthermore, the user can hold the base plate 12 in the air with his feet while lying on the floor in order to pull on the straps 14 for a different exercise. Additionally, the user can pull on the straps 14 while holding the base plate 12 across his chest.

Figure 5:
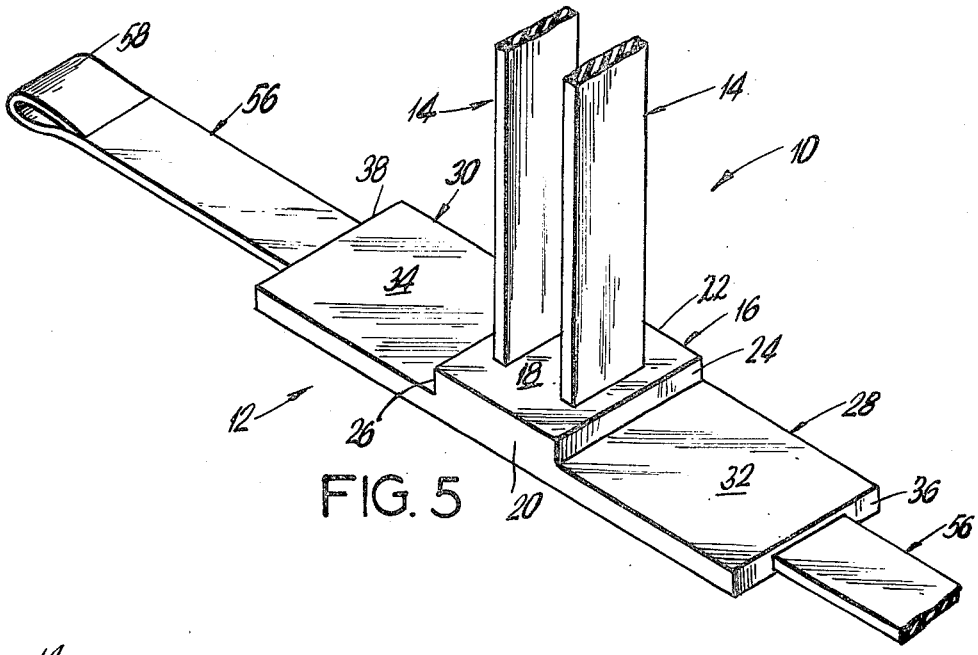
FIG. 5 is a perspective view of another embodiment of the exercising device of the present invention.
Figure 6:
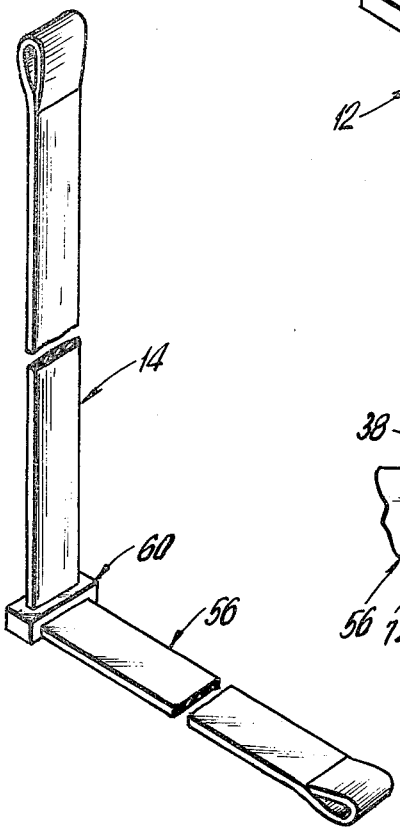
FIG. 6 is a perspective view of interconnected straps for use in the embodiment shown in FIG. 5.

Referring now to FIG. 5, there is shown an alternate embodiment of the present invention where, in addition to the upwardly extending straps, there is also provided laterally extending straps 56. The lateral straps also include handle portions 58 which are also formed, as set forth above, by bending the end to form a loop. In order to provide both upwardly extending straps and horizontal laterally extending straps, reference is made first to FIG. 6 where it is noted that a single block-like lug 60 is utilized to interconnect the upwardly extending strap 14 and the laterally extending strap 56 into an L-shaped configuration, with the straps being substantially perpendicular to each other.

Figure 7:
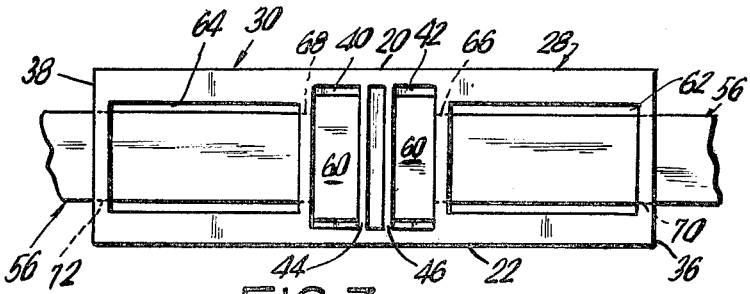
FIG. 7 is a bottom view of the exercising device shown in FIG. 5.

In order to accommodate the horizontal strap 56 of the L-shaped configuration of the straps, the base plate is modified as shown in FIG. 7. Elongated recesses or wells 62, 64 are respectively formed in each of the lateral extensions 28, 30. Slots or passageways 66, 68 respectively interconnect each recess 62, 64 with its respective adjacent channel 42, 40. Further slots 70, 72 are formed in the respective end walls 36, 38 of the laterally extending portions 28, 30, and communicate in alignment respectively with the recesses 62, 64. With this construction, a passageway is formed from the channels 42, 40, outwardly through the respective lateral extensions 28, 30. The block-like lugs 60 are inserted into the respective channels 42, 40 with the vertical straps 14 extending upwardly through the slots respectively formed in the enlarged central portion. The laterally extending horizontal straps 56 are threaded through the passageways and out past the end walls to laterally extend from the base plate on either side thereof. Because of the open recesses 62, 64 formed at the bottom of each lateral extension of the base plate, it is easy to manipulate and thread the horizontal straps through the passageways provided.

Figure 8:
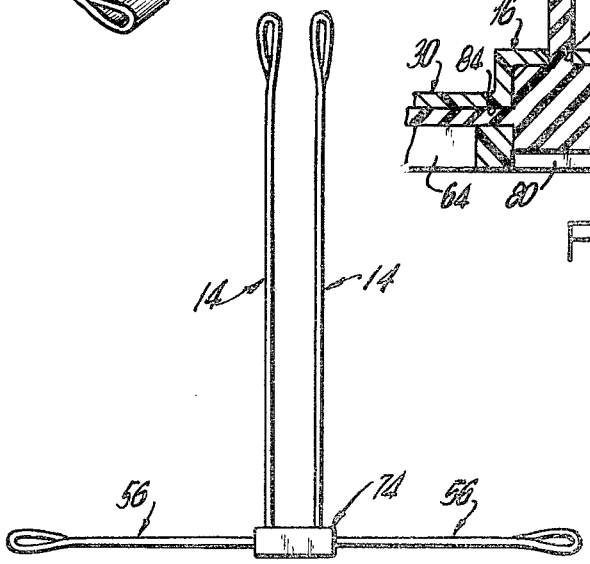
FIG. 8 is a side view of an alternate embodiment of the straps for use in a device of the type shown in FIG. 5.

Referring now to FIG. 8, there is shown an alternate embodiment for the straps providing for both vertical and horizontal straps for use in a device of the type shown in FIG. 5. As noted in FIG. 8, there is a single common block-like lug 74 which interconnects all four straps, and more specifically, the two vertical straps 14 as well as the two horizontal straps 56. Each of the four straps has its proximal end interconnected to the common lug 74. In this way, the shape of the lug 74 is substantially wider than the shape of the heretofore described lugs 52 and 60, being at least approximately twice the width of either of the lugs 52 and 60.

Figure 9:
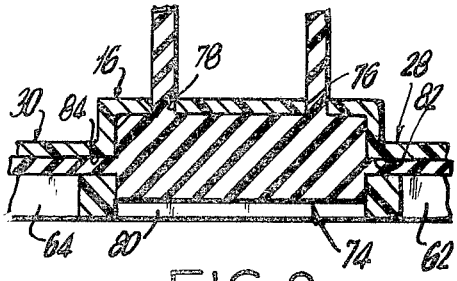
FIG. 9 is a side sectional view of an exercising device utilizing the interconnected straps of FIG. 8.

FIG. 9 shows a cross-sectional view of the base plate which can accommodate the enlarged block-like lug 74 shown in FIG. 8. In this case, the two slots 76, 78 are provided vertically into communication with a single channel 80 formed in the enlarged central portion 16, for example, by removing the above mentioned internal walls 44, 46 to thus combine the two channels 40 and 42 into the one channel 80. The side passage-ways 82, 84 extend from the single channel 80 and into the recesses 62, 64 respectively formed in the lateral extensions 28, 30 of the base plate.

Figure 10:
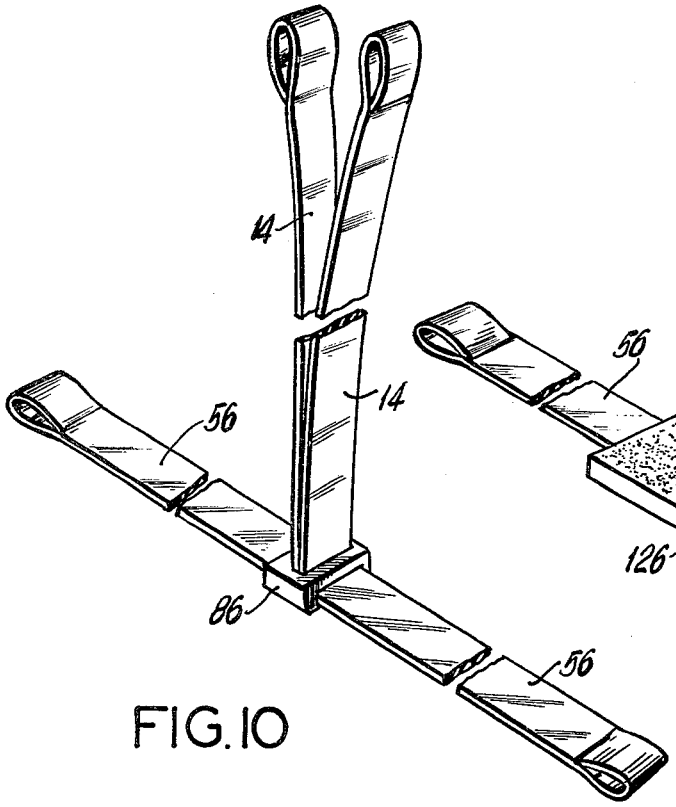
FIG. 10 is a perspective view of a modified embodiment of the straps shown in FIG. 8.

FIG. 10 shows a further modified embodiment for the straps similar to the embodiment of FIG. 8, where the vertical and horizontal straps are connected to a single common block-like lug 86. However, while the vertical straps 14 on the lug 74 of FIG. 8 are spaced apart at the lug 74, the vertical straps 14 on lug 86 of FIG. 10 are disposed adjacent to each other in a side-by-side relationship at the lug 86. Thus, the shape of the lug 86 is narrower than the shape of the lug 74, but is substantially wider than the heretofore described lugs 52 and 60, being approximately twice the width of either of the lugs 52 and 60. The relationship of the two horizontal straps 56 on lug 86 is similar to the two horizontal straps 56 on the lug 74 except obviously for the spacing of the lug therebetween.

Figure 11:
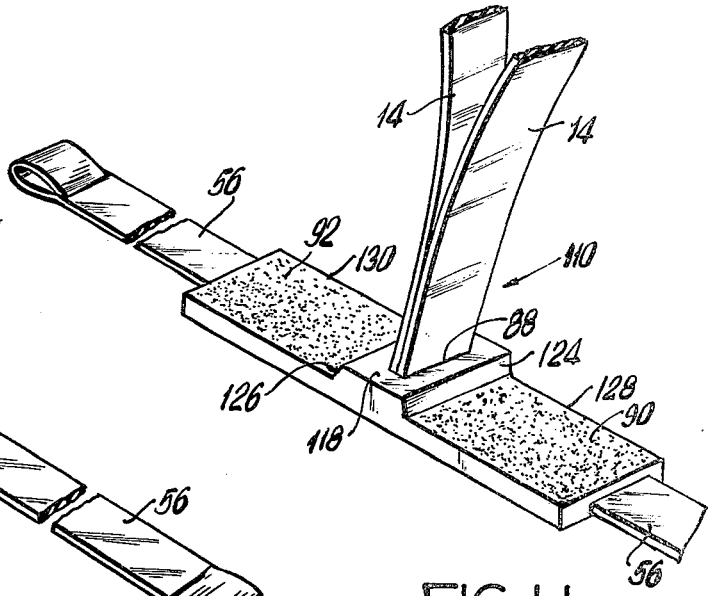
FIG. 11 is a perspective view of an exercising device utilizing the straps of FIG. 10.
Figure 12:
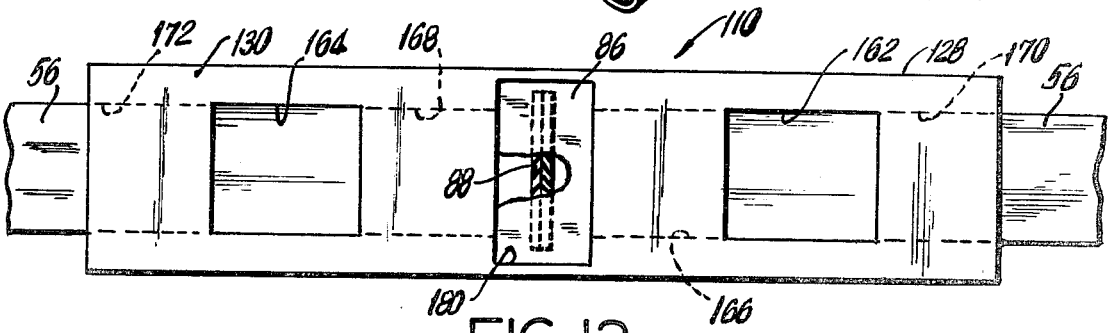
FIG. 12 is a bottom view of the device shown in FIG. 11 with a portion cut away.

FIG. 11 shows a modified base plate 110 to accommodate the lug 86 and strap arrangement thereof shown in FIG. 10. The base plate 110 is similar to the base plate 10 discussed above, however only one slot 88 is provided in the top surface 118 of the enlarged central portion. The slot 88 communicates with the single channel 180 which receives the lug 86 therein, as shown in FIG. 12. The base plate 110 includes recesses or wells 162, 164, and slots or passageways 166, 168 in addition to the slots 170, 172 to provide passageways from the channel 180 outwardly through the respective lateral extensions 128, 130 for receiving the horizontal straps 56 in a similar manner as set forth above in the discussion of FIGS. 5–9.

It is noted, that the top surfaces 90, 92 of the lateral extensions 128, 130 are non-smooth or roughened in order to provide a non-slip surface for the user's feet, where the previously discussed base plate 10 can also be provided with such a non-slip surface. Furthermore, the side walls 124, 126 of the central portion are tapered outwardly towards the surfaces 90, 92 of the lateral extensions in order to provide a stronger support for the central portion. The side walls 24, 26 of the base plate 10 can also be tapered for increased support thereof in a similar manner.

Figure 13:
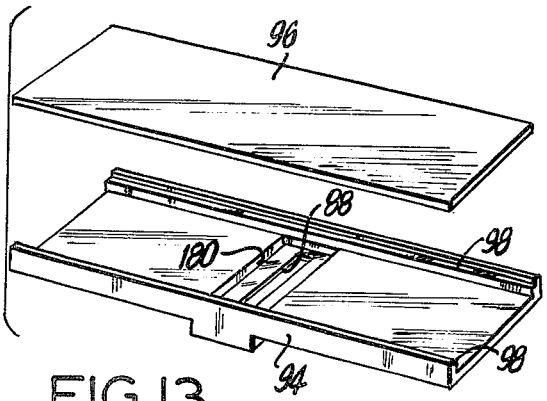
FIG. 13 is an exploded perspective view of a modified embodiment of the device shown in FIG. 11.

Though the base plate heretofore discussed has been fabricated from a molded one piece construction, FIG. 13 shows the base plate being constructed from a top portion 94 and a bottom wall 96. The top portion 94 is provided with the channel 180 and the slot 88, and also includes a recess 98 on the lower edge of each of the front and rear walls. After the lug 86 has been positioned in the channel 180, with the straps 14 extending through the slot 88 and the straps 56 extending outwardly through the lateral extensions, the bottom wall 96 is positioned on the recesses 98 and secured thereto by conventional means such as adhesive cement, heat treatment, sonic sealing and the like, to provide the above mentioned passageways from the channel outwardly through the lateral extensions.

Figure 14:
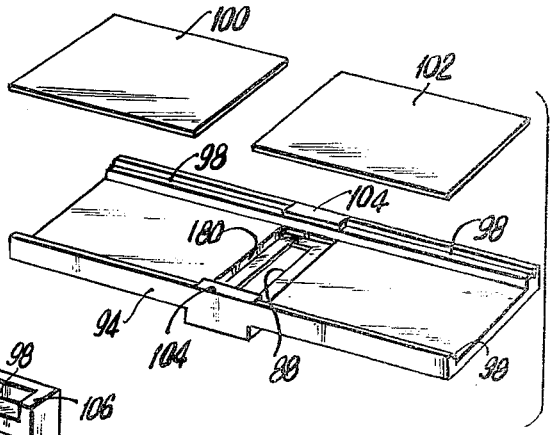
FIG. 14 is an exploded perspective view of another modified embodiment of the device shown in FIG. 11.

FIG. 14 shows a modified base plate similar to the base plate shown in FIG. 13. However, the bottom wall is formed from two pieces 100, 102 rather than the one piece construction of FIG. 13. Additionally, stops 104 are centrally positioned in the recesses 98 with respect to the enlarged central portion for locating and positioning the bottom walls 100, 102 which are disposed on each side thereof within the recesses 98. The securement of the two piece bottom wall 100, 102 is similar to that of the bottom wall 96 of FIG. 13 to provide the above mentioned passageways.

Figure 15:
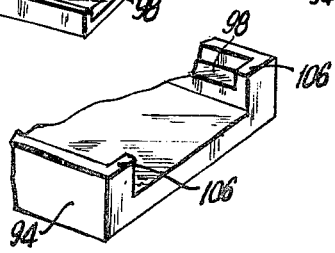
FIG. 15 is a fragmentary, perspective view of a modified end portion for the devices shown in FIGS. 13 and 14.

FIG. 15 discloses a modified end of the top portion 94 shown in FIGS. 13 and 14, wherein tabs or abutments 106 are disposed at the opposite ends of each of the recesses 98 to prevent the bottom wall 96 or 100, 102 from sliding in the recesses 98. These tabs 106 are particularly useful when the pieces are sonically sealed together so that the bottom wall is held relatively stationary with respect to the top portion 94 during the sealing process.

In each embodiment of the present invention, the vertical straps 14 are made twice as long as the horizontal straps 56. The vertical and horizontal straps being, of course, substantially perpendicular to each other.

The elastic straps and lugs can be made of rubber or other similar material which permits the straps to be stretched. The frame or base plate can be of plastic material, or a sturdier and stronger steel material. Other similar types of material can also be utilized.

In an embodiment of the invention, the straps were made approximately 1½ inches wide, with the vertical straps being 20 inches long and the horizontal straps being 10 inches long. The entire length of the base plate was 10 inches long and 3 inches wide. The height of the side lateral extensions were approximately ⅜ inches high, and the enlarged central section extended upwardly from the side sections by an additional ⅜ of an inch.

In utilizing the invention as described, the individual can place his feet on the side extensions. Because the central portion is raised, the side walls of the central sections can provide a stop for the feet, so that the user's feet can abut against the side walls and be maintained in a spread apart condition. The user can then manipulate the upwardly extending straps with his hands. At the same time, the device can be used so that the outwardly extending straps can be used by the feet. Additionally, as is well known, because of the mutually perpendicularly directed straps other types of exercises can similarly be available with this exercising device.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An exercising device comprising a base plate having channel means therein and slot means extending through said base plate to said channel means, elastic strap means including elastic straps having a handle member at one end of each strap and integral block-like lug means disposed at an opposite end thereof corresponding in shape to said channel means, said block-like lug means being retained in said channel means to secure said strap means to said base plate, said strap means passing through said slot means extending outwardly from said base plate, said base plate including an enlarged central portion and lateral extensions on either side thereof, said elastic strap means extending upwardly from said enlarged central portion, said lateral extensions each having a flat upper surface adapted to receive a user's feet while exercising with said elastic strap means, said strap means including two vertical elastic straps extending upwardly from said enlarged central portion, and two horizontal straps extending laterally outwardly from said lateral extensions.

2. An exercising device as in claim 1, wherein each of said lateral extensions comprise an elongated rectangular block, a recess formed into a bottom of each lateral extension, and passageway means at both ends of each recess for connecting each recess with said channel means on one side of each recess, and for extending from said recess through respective end walls of the lateral extensions on the other side of each recess, said passageway means receiving said two horizontal straps therethrough respectively.

3. An exercising device as in claim 1, wherein said lug means includes two block-like lugs, each lug being integrally connected to one vertical strap and one horizontal strap to provide an L-shaped configuration, said channel means including two substantially identical spaced apart channels transversely positioned in said enlarged central portion, each channel receiving a respective one of said two lugs.

4. An exercising device as in claim 1, wherein said lug means includes one block-like lug, all of said vertical and horizontal straps being integrally interconnected at their proximal ends to said block-like lug, said channel means including a single channel in said enlarged central portion to receive said lug.

5. An exercising device as in claim 4, wherein said slot means includes two slots extending through said enlarged central portion with a respective one of said vertical straps passing through an associated one of said two slots, said vertical straps being spaced apart from each other at said one block-like lug.

6. An exercising device as in claim 4, wherein said slot means includes one slot extending through said enlarged central portion with both of said vertical straps passing through said one slot, said vertical straps being disposed adjacent to each other in a side-by-side relationship at said one block-like lug.

7. An exercising device as in claim 1, wherein said vertical straps are approximately twice as long as said horizontal straps.

8. An exercising device as in claim 1, wherein said handle members are provided by folded over distal ends of said strap means to define a loop for each strap.

9. An exercising device comprising a base plate having channel means therein and slot means extending through said base plate to said channel means, elastic strap means including elastic straps having a handle member at one end of each strap and integral block-like lug means disposed at an opposite end thereof corresponding in shape to said channel means, said block-like lug means being retained in said channel means to secure said strap means to said base plate, said strap means passing through said slot means and extending outwardly from said base plate, said base plate including an upper member and a bottom member, said upper member having an enlarged central portion and lateral extensions on either side thereof, said central portion and lateral extensions being provided with recess means for receiving said bottom member to provide a bottom surface for said base plate.

10. An exercising device comprising a base plate having channel means therein and slot means extending through said base plate to said channel means, elastic strap means including elastic straps having a handle member at one end of each strap and integral block-like lug means disposed at an opposite end thereof corresponding in shape to said channel means to secure said strap means to said base plate, said strap means passing through said slot means and extending outwardly from said base plate, said base plate including an upper member and two bottom members, said upper member having an enlarged central portion and lateral extensions on either side thereof, said lateral extensions being provided with recess means for receiving said bottom members in a spaced apart arrangement to provide bottom surfaces for said base plate.

* * * * *